US005159728A

United States Patent [19]

Bingold

[11] Patent Number: 5,159,728

[45] **Date of Patent: * Nov. 3, 1992**

[54] TWO-LOOP LAW ENFORCEMENT STRAP RESTRAINT WHICH IS CONCEALABLE, DISPOSABLE AND CAN BE FORMED ENTIRELY OF RECYCLABLE MATERIAL

[76] Inventor: Richard F. X. Bingold, 8779 Haymarket Rd., Brewerton, N.Y. 13029

[ * ] Notice: The portion of the term of this patent subsequent to Mar. 27, 2007 has been disclaimed.

[21] Appl. No.: 638,618

[22] Filed: Jan. 8, 1991

[51] Int. Cl.[5] ..... E05B 75/00; B65D 63/00

[52] U.S. Cl. ..... 24/16 PB; 24/484; 70/16

[58] Field of Search ..... 70/15-18, 70/16; 24/16 PR, 16 R, 17 AP, 30.5 P, 484, 16 PB; 248/74.3

[56] References Cited

U.S. PATENT DOCUMENTS

| | | | |
|---|---|---|---|
| 4,071,023 | 1/1978 | Gregory | 70/16 X |
| 4,136,148 | 1/1979 | Joyce | 24/16 PB X |
| 4,227,668 | 10/1980 | Ernst | 24/16 PB X |
| 4,532,679 | 8/1985 | Scott | 24/17 AP X |
| 4,752,054 | 6/1988 | Jönsson | 24/16 PB X |
| 4,825,156 | 4/1989 | Read | 24/16 PB X |
| 4,909,051 | 3/1990 | Lee | 248/74.3 X |
| 4,910,831 | 3/1990 | Bingold | 24/16 PB |
| 4,942,644 | 7/1990 | Rowley | 24/16 PB |

FOREIGN PATENT DOCUMENTS

| | | | |
|---|---|---|---|
| 2145150 | 3/1985 | United Kingdom | 24/16 PB |

*Primary Examiner*—James R. Brittain
*Attorney, Agent, or Firm*—Katherine McGuire

[57] ABSTRACT

A two-loop strap restraint for law enforcement is lightweight, strong, inexpensive, disposable, and can be formed entirely of recyclable polymeric material, and is easy to apply and carry. This restraint has a pair of apertures in its central bridging portion for curling into a compact four-loop configuration for easily carrying several of them in an unobtrusive, concealed manner in a pocket. The restraint fits all size wrists, ankles for use in a wide variety of law enforcement situations. It has the general form of a single non-metal elongated strap of polymeric material having a pair of symmetrically positioned latching socket bosses of polymeric material located near the center of the strap with a resilient latching pawl formed of polymeric material positioned in each socket. A flexible ratchet portion of the restraint extends outwardly from each socket boss with a narrow tip pull extending outwardly from the ratchet portion to a rounded tip. In use, a tip pull is inserted through a socket opening. The resilient pawl allows the flexible ratchet portion to be drawn forwardly in an insertion direction through the socket for engaging snugly around a wrist, ankle or anchoring member, then the pawl prevents the inserted ratchet portion of the strap restraint from being moved backwardly from the socket in an extraction direction for securely holding a restrained limb (arm or leg). The socket bosses project solely toward the outside of the restraint for facilitating quickly, properly inserting tip pulls into socket mouths in the dark.

21 Claims, 6 Drawing Sheets

TWO-LOOP LAW ENFORCEMENT STRAP RESTRAINT WHICH IS CONCEALABLE, DISPOSABLE AND CAN BE FORMED ENTIRELY OF RECYCLABLE MATERIAL

FIELD OF THE INVENTION

This invention relates to law enforcement restraining devices and more particularly relates to a two-loop strap restraint which is concealable, disposable and can be formed entirely of recyclable material. The strap restraint is removed from the person or animal being restrained by cutting or snipping it off, thus not requiring a key for opening

BACKGROUND

A prior two-loop law enforcement retraining device is disclosed and claimed in my U.S. Pat. No. 4,910,831, issued May 27, 1990.

The conventional restraining device used by law enforcement officers and others consists of a pair of connected metal rings that can be locked about the wrists of a prisoner to keep him from using his hands or to fasten him to the law enforcement officer or to some other object such as a fence or a post or attachment to an anchoring member in a transport vehicle. These conventional handcuffs require a key, are bulky, heavy, and the oval opening defined, though adjustable in length, is typically not adjustable in width for snugly engaging different thicknesses of wrists or ankles.

In addition, when multiple arrests are involved, multiple sets of handcuffs may be required, which burden the officers with carrying a plurality of rather difficult to handle and heavy metallic objects. Such metal handcuffs will activate metal detectors in airports, courthouses, prisons, government buildings and other protected structures, thus giving rise to awkward, confusing and complicating situations during transport and legal processing of an arrested person.

Law enforcement work requires handling of individuals for transporting and transferring from one facility to another. For processing, booking, etc., the prisoners normally are turned over from one officer or agency to another, thereby requiring one set of handcuffs to be removed and given back to the first officer (who is transferring the prisoner to a second officer) and for the application of a different set of handcuffs provided by the transferee. Any change, or removal and replacement of the restraining devices on a prisoner is dangerous and provides an avenue of opportunity for the prisoner to injure an officer or escape while such transporting transfers are being made.

Further, each removal and replacement of sets of handcuffs necessarily inherently involves close physical contact between the law enforcement personnel and the prisoner. Such close contact unfortunately exposes the law enforcement personnel to the hazard of contracting disease, particularly so if the prisoner is bleeding or is coughing from respiratory disease.

Moreover, since a key is necessary to remove conventional handcuffs, the transporting or arresting officer may be assaulted in attempts to obtain the key. In other words, the use of the conventional, expensive, key-opened handcuffs as restraining devices provide a plurality of problems and risks when they are applied or removed from the person or persons to be restrained and during transport of a restrained person or persons.

SUMMARY OF THE DISCLOSURE

Accordingly, it is an object of the present invention to provide a new and improved law enforcement strap restraint which is lightweight, strong, inexpensive, disposable, can be formed entirely of recyclable polymeric material and is easy to use, easy to operate and store and is less complex than prior art types of restraints.

By virtue of the fact that this strap restraint is inexpensive and disposable and does not involve the use of a key, the same restraint may remain securely positioned on a prisoner until the subject reaches an intended detention facility before the restraint is removed by cutting or snipping it off.

Moreover, since a strap restraint embodying the invention is formed entirely of polymeric material, it will not activate metal detectors. Thus, this novel strap restraint facilitates movement of a restrained prisoner into and out of locations protected by metal detectors, such as airports, prisons, courthouses, government buildings and so forth.

The strap restraints are made of a tough, strong, stiffly flexible polymeric material, are lightweight, and a considerable number of them may be carried conveniently concealed by a law enforcement user and are disposable, as contrasted with bulky, expensive, heavy, metal handcuffs, which require an accompanying key for release.

A further object of this invention is to provide a novel and improved, two-loop law enforcement restraining device which is not complex and facilitates restraining individuals alone or in a group, helping in the handling of individuals for the transportation transfer from one facility to another and during the processing of the restrainees with no risk involved which would be involved in removing and replacing conventional handcuffs during transfer from one officer to the next as often occurs in such operations.

Still another object of this invention is to provide a new and improved two-loop law enforcement restraining device which facilitates the restraint and movement of multiple subjects.

Still a further object of this invention is to provide a new and improved two-loop law enforcement restraining device which is simple to operate, is lightweight, inexpensive and disposable and may be safely applied and is not key-operated.

Another object of the present invention is to provide a new and improved two-loop law enforcement restraining device which reduces the risk in handling prisoners that might otherwise subject the law enforcement officers to repeated contact or close association with prisoners who might be bleeding and might have a blood-contact conveyable disease, or might have some infectious respiratory disease.

Among the advantages of a strap restraint embodying the present invention are those arising from the fact that this restraint has a pair of apertures in its central bridging portion for enabling the strap restraint to be curled into a compact four-loop configuration for convenience in carrying several of them by a law enforcement officer in an unobtrusive, concealed manner, for example, in a pocket.

This strap restraint fits all sizes of wrists and ankles for use in a wide variety of law enforcement situations, including securing together two or more subjects in custody as in quelling riots or gangs or in military situations involving prisoners, or in medical situations involving necessary restraint of a viciously violent or self-destructively-acting individual, or even in hobbling a prisoner who has kicked at another person.

In carrying out this invention in an illustrative embodiment thereof a law enforcement restraining device of the double-loop type for attachment around the wrists or ankles of the restrained person comprises a disposable, single, elongated strap restraint having first and second stiffly flexible, longitudinally extending ratchet portions. The strap includes first and second latching socket bosses spaced longitudinally of the strap and being located near the center of the strap between the first and second stiffly flexible ratchet portions. The first and second ratchet portions have respective first and second tip portions, and the strap includes a central bridging portion extending between the first and second latching socket bosses. The bridging portion has a width at least substantially commensurate with the width of the latching socket bosses; and this bridging portion has first and second apertures therein spaced longitudinally of the strap. These apertures have sufficient size for enabling the strap to be curled into a compact four-loop configuration with a ratchet portion and also a tip portion extending through each of said apertures in withdrawable relationship.

BRIEF DESCRIPTION OF THE DRAWINGS

The invention, together with further objects, aspects, features and advantages of a two-loop law enforcement restraining device embodying the invention in presently preferred forms will be more clearly understood from a consideration of the following description in connection with the accompanying drawings in which like elements bear the same reference numerals throughout the various views.

FIG. 3 is a view taken along the stepped viewing line 3—3 in FIG. 4.

FIG. 4 is a view obtained by looking from the position 4—4 toward FIG. 3.

FIG. 5 is an enlargement of the tip pull and ratchet portions of the strap restraint shown in FIG. 3.

FIG. 6 is a view looking upwardly at the restraint portions shown in FIG. 5. It is an enlargement of portions of the strap restraint shown in FIG. 4.

FIG. 7 is an enlargement of the section shown in FIG. 3.

DETAILED DESCRIPTION OF PREFERRED EMBODIMENTS OF THE INVENTION

Figure 1:
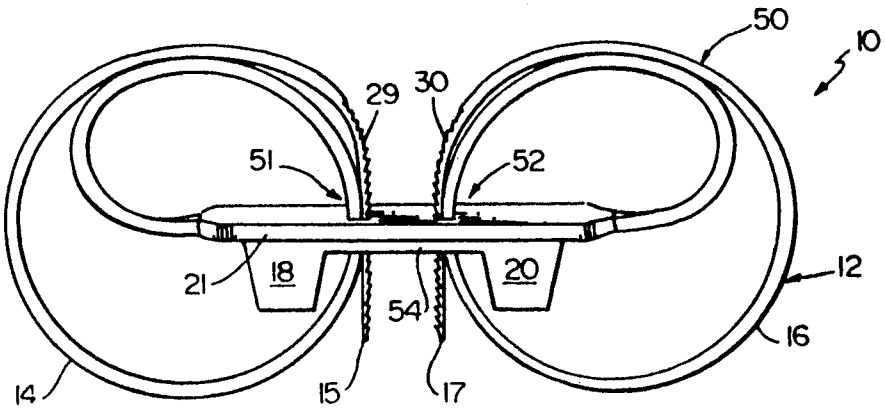
FIG. 1 is a side-elevational view of a law enforcement strap restraint embodying the present invention. It is shown curled into a compact four-loop configuration for ease of carrying in a pocket in an unobtrusive concealed manner. There are a pair of symmetrically located apertures (as seen in FIG. 2) in a central portion of the strap through which respective ratchet portions of the strap are inserted with the strap tip portions also being pushed into these apertures in withdrawable relationship for convenience in curling the strap restraint temporarily into this compact, easy-to-carry, four-loop configuration.

A law enforcement strap restraint embodying the present invention has no need for a key to unlock either loop once it has been applied around the wrist or ankle of a restrained prisoner, for this restraint is in the general form of a stiffly flexible strap of polymeric material; it is disposable and is cut for removal. The strap restraining device is bent for forming two loops adapted to restrain either humans or animals and is attached to limbs, such as arms and legs, in the vicinity of the wrists and ankles, respectively.

Among the advantages of the lightweight strap restraint are those resulting from the fact that a law enforcement officer can easily carry a plurality of them. These stiffly flexible strap restraints can readily be looped around each other in numerous ways for being coupled together with one or more of the loops being attached to the same or other individuals or animals, and such coupling may include anchoring one of the loops to a stationary member such as a post, pipe, fence or other object or to an anchoring member in a transport vehicle. The restraining device referred to herein will not require a key or other unlatching element and is inexpensive and disposable in that once it has been applied, it is removed by simply cutting or snipping it from the person being restrained.

Since the strap restraint is inexpensive and disposable and does not require an accompanying key for release, the same restraint may remain securely positioned on a subject until reaching an intended detention facility before the restraint is removed by cutting or snipping it off.

Referring to FIGS. 1 through 4, a law enforcement strap restraint embodying the present invention is referred to generally by the reference numeral 10 and comprises a single, elongated, integral, stiffly flexible strap 12 having first and second ratchet portions 14 and 16, respectively, with respective rounded tips 15 and 17. The strap 12 is preferably molded of a lightweight, strong, tough, stiffly flexible, high-strength, engineering-type, thermoplastic, polymeric material, for example, it is molded of engineering grade Nylon 66 or Nylon 6 each being a virgin resin impact-modified to enhance flexibility and having a tensile strength of at least about 8,000 psi (ASTM Test Method D 638) and a flexural strength of at least about 13,500 psi.

This tough strap can be cut with a pair of large cutting snips or large cutting shears, but such cutting is not easily done. The strap 12 contains first and second socket bosses 18 and 20, respectively, which are centrally located in the strap 12 generally midway between the first and second rounded tips 15 and 17. It is to be noted that the restraint 10 is symmetrical about a transverse centerline 19 (FIGS. 2, 3 and 4) and thus the socket bosses 18 and 20 are each located the same relatively small distance "D" on either side of this centerline 19. There is a relatively wide bridging portion 21 of the strap 12 which spans between and is integral with the respective socket bosses and is reinforced by two longitudinal ribs 54 for strongly and securely interconnecting these sockets. This restraint 10 is also advantageously symmetrical about a longitudinal centerline axis 23 (FIGS. 2 and 3), so that it is conveniently reversible end-for-end when being applied. In other words, the user need not waste time in checking which tip 15 and 17 is to be inserted first, because of the advantageous symmetry of this useful tool 10.

Figure 3:
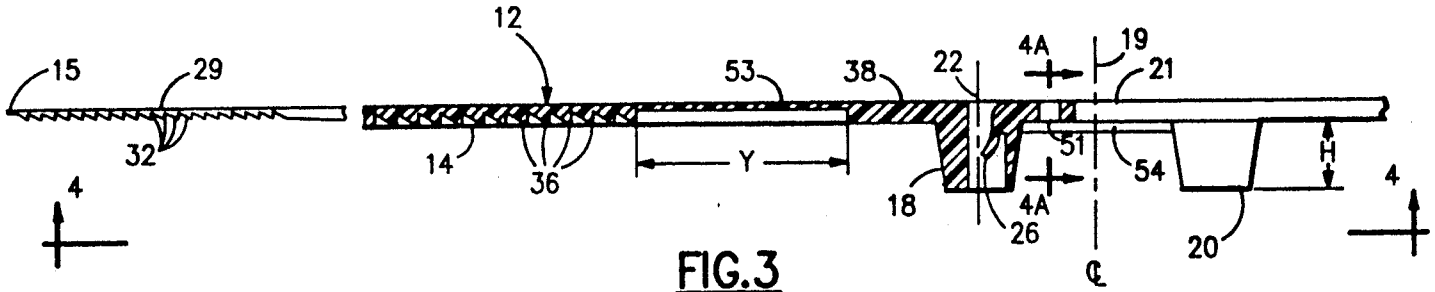
FIG. 3 is a side-elevational view of somewhat more than one-half of the strap restraint shown straightened out. Both latching socket bosses are seen projecting solely from the outside surface of this strap restraint. One of the latching sockets is shown in longitudinal section, with an adjacent portion of the strap restraint also being shown in longitudinal section.
Figure 7:
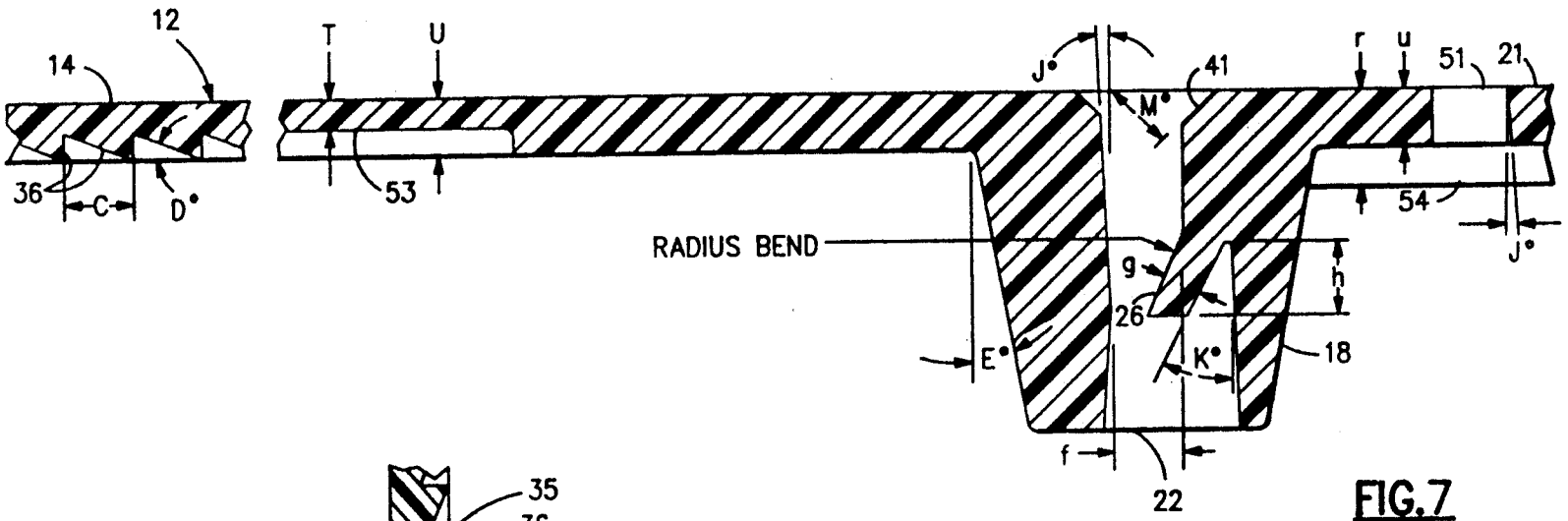
FIG. 7 is a longitudinal sectional view of a latching socket and an adjacent portion of the strap restraint shown enlarged about four times.
Figure 8:
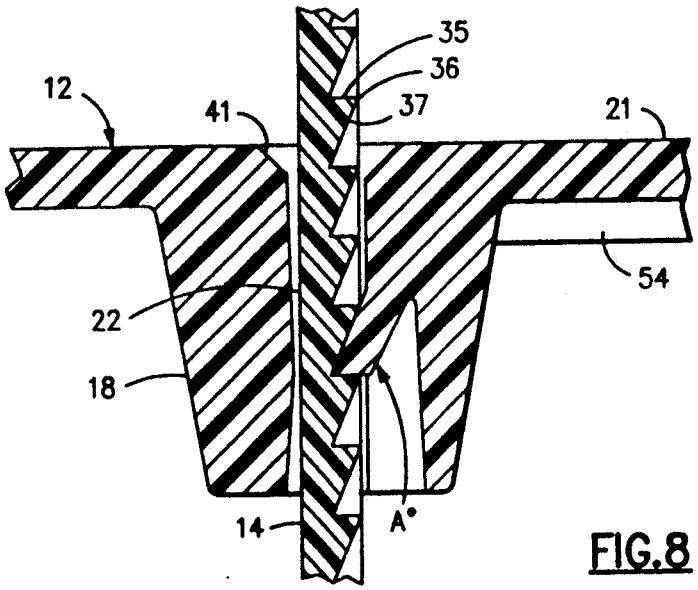
FIG. 8 is a sectional view of the latching socket as shown in FIG. 7 showing a resilient latching pawl engaged with an inserted ratchet portion of the restraining device. The resilient latching pawl is non-metallic, being molded integral with the socket boss.

The first and second spaced socket bosses 18 and 20 have central openings 22 and 24, respectively, extending therethrough which openings are substantially perpendicular to the plane of the elongated straight strap 12 as will best be seen in FIGS. 3, 7 and 8. As seen in FIGS. 3, 7 and 8, the socket 18 includes a downwardly extending resilient latch pawl 26 which is inclined downwardly in a direction away from the transverse centerline 19. This latch pawl 26 projects into the opening 22 of the socket 18 for ratchet latching purposes explained hereinafter. The other socket 20 also includes an identical downwardly inclined resilient latch pawl 28 which projects downwardly into the opening 24 in a direction away from the centerline 19. These latch pawls 26 and 28 are molded of the same polymeric material used for molding the strap 12 and socket bosses 18 and 20, so that these pawls are integral with their respective socket bosses. By virtue of being non-metallic, these pawls 26 and 28 will not activate metal detectors.

Figure 2:
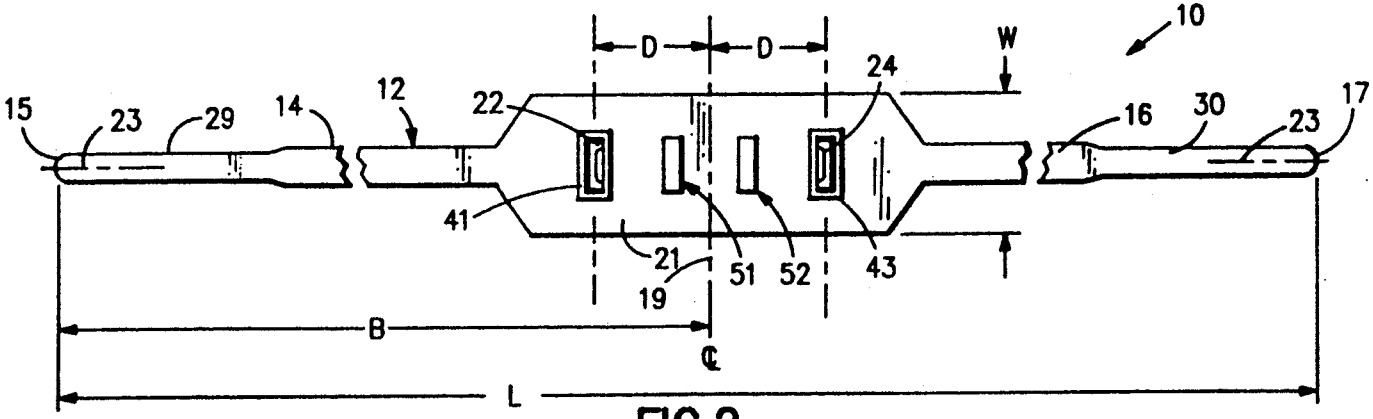
FIG. 2 is a plan view of the inward surface of the strap restraint showing the symmetrically located pair of apertures positioned between a symmetrically positioned pair of latching openings. The latching openings are located within respective socket bosses.
Figure 4:
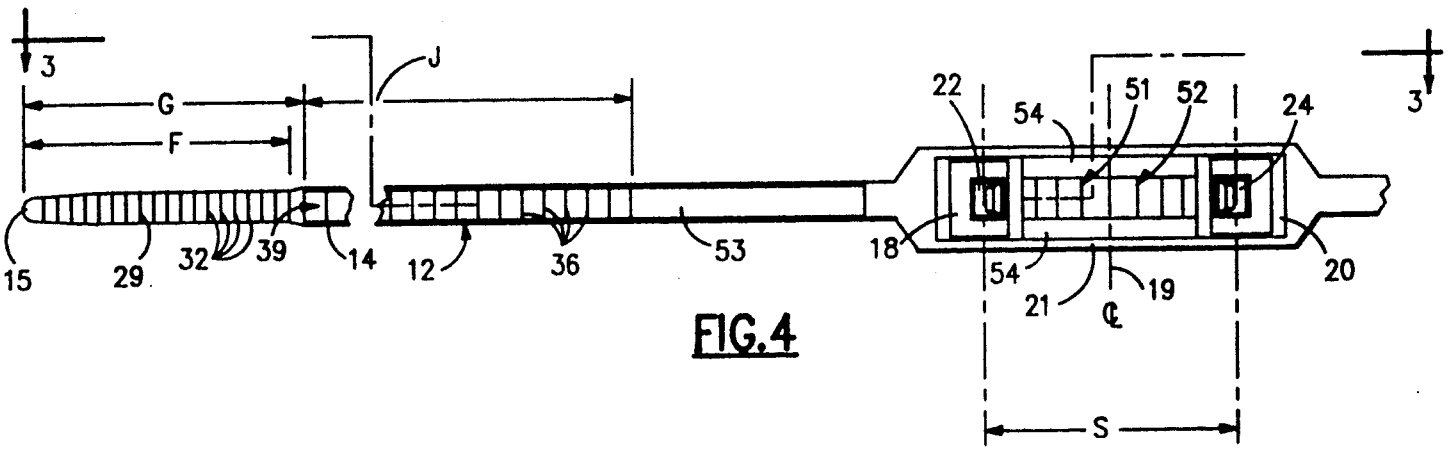
FIG. 4 is a plan view of more than one-half of the strap restraint as seen looking toward its outward surface with the strap restraining device shown straightened out.
Figure 5:
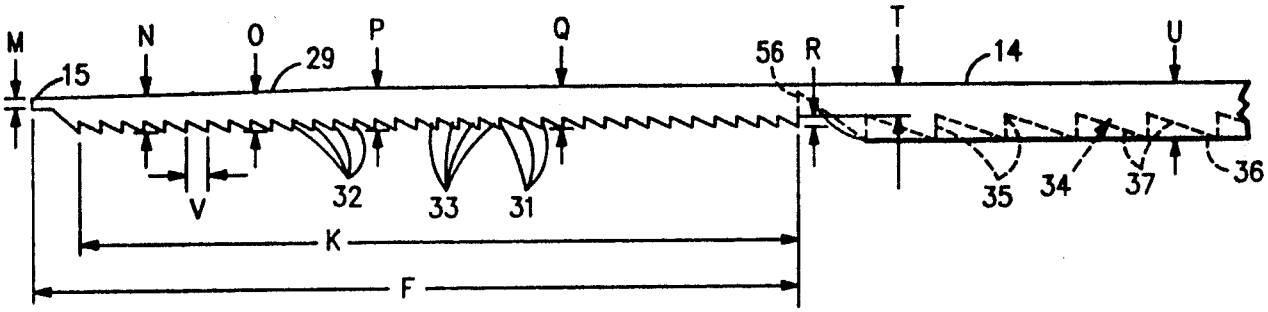
FIG. 5 is a partial side-elevational view showing a tip pull portion and part of the nearby ratchet portion of the strap restraint shown enlarged about four times.
Figure 6A:
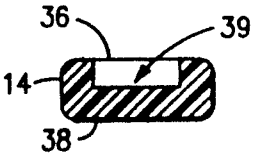
FIG. 6A is a cross-sectional view taken along the line 6A—6A in FIG. 6 and shown with the outward side of the strap facing upwardly.
Figure 6:
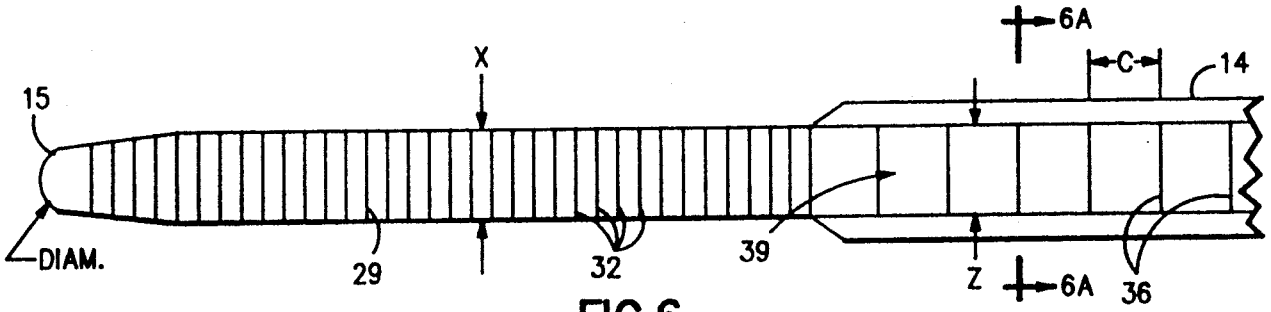
FIG. 6 is a partial plan view of a narrowed tip pull portion and nearby ratchet portion of the strap restraint shown enlarged about four times.

As best seen in FIGS. 2, 4 and 6, the strap 12 includes a first narrowed tip pull portion 29 extending inwardly from the rounded tip 15 to the ratchet portion 14. This narrowed tip pull portion 29 is shown having a width, as seen in FIG. 6, in the range of about 50% to about 70% of the width of the ratchet portion 14, for example being about 58%. This tip pull is tapered in thickness as seen in FIG. 5 and includes a plurality of small ridges 32 extending transversely with respect to the longitudinal centerline 23. These small ridges 32 have a saw-tooth configuration as seen in FIGS. 3 and 5 with their abrupt faces 31 being on the mesial surface of each ridge and with their sloping faces 33 being on the distal surface. The narrowed tip pull 29 has a length "F" (FIGS. 4 and 5). For example, this length F is in the range from about one inch to about two inches, and preferably is about 1.5 to about 1.8 inches, with a most preferred dimension F of about 1.65 inches. The purpose of this saw-toothed tip pull 29 is to provide a high frictional grip by an officer when pulling on it after the narrowed tip pull portion 29 has been inserted fully through the socket opening 22 for enabling firm manual pulling of the ratchet portion 14 through the socket 18. The narrowed tip pull 29 leads to a ratchet toothed channel surface 34 having larger saw-tooth ridges 36 which slope in the same direction as the smaller ridges 32 of the tip pull. Thus, these larger saw-tooth ridges have abrupt mesial faces 35 and sloping distal faces 37 for providing a stiffly flexible longitudinally extending first ratchet portion 14 of the strap 12.

As seen in FIGS. 3, 4, 5, 6 and 6A, the ratchet portion 14 has a broad trough-shaped (broad U-shaped) configuration forming a channel 39 in which is located the saw-toothed surface 34. The broad flat surfaces 38 of the first and second ratchet portions 14 and 16 of the strap 12 are considered the "bottom" or "inward" surfaces, because such surfaces 38 are intended to face inwardly toward the wrist or ankle of the restrained person. Conversely, the surface containing the channel 39 is considered the "top" or "outward" surface. This top surface must face the resilient latch pawl 26 for it to engage against the abrupt mesial ridge faces 35 for latching the ratchet portion 14 in the socket as shown in FIG. 8.

The second ratchet portion 16 (FIG. 2) of the strap 12 is molded in the same shape as the first ratchet portion 14, except that this second ratchet portion is the symmetrical mirror image of the first. There is a second narrowed tip pull portion 30 (FIG. 2) which is molded in the same shape as the first tip pull portion 29, except that this second narrowed tip pull is the symmetrical mirror image of the first.

Figure 9:
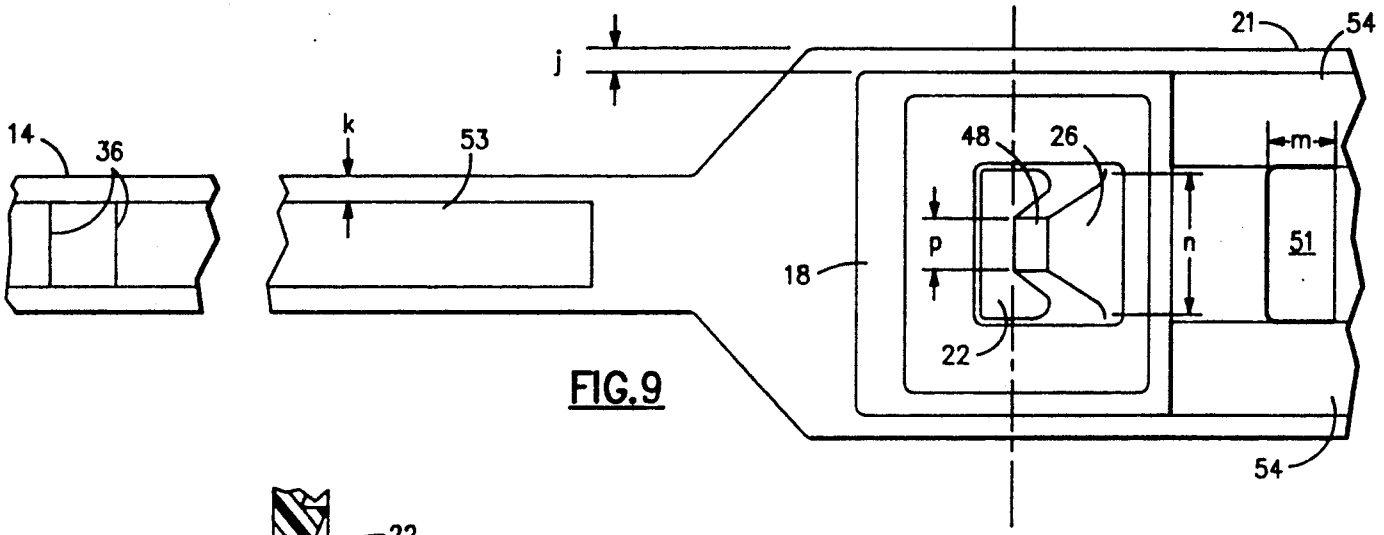
FIG. 9 is an enlargement about four times of one of the latching sockets shown in FIG. 4 as seen from the outside of the restraining device.

FIGS. 7, 8 and 9 more fully illustrate the structure of the socket 18 which has a central opening 22 with a funnel-shaped insertion mouth 41. The downwardly inclined latch pawl 26 projects into the central opening and is adapted to contact the teeth 36 of the saw-toothed channel surface 34 to latch for retaining the ratchet portion 14 within the socket 18 once it has been inserted therein and pulled into a final looped configuration 45 (FIG. 1A).

Figure 1A:
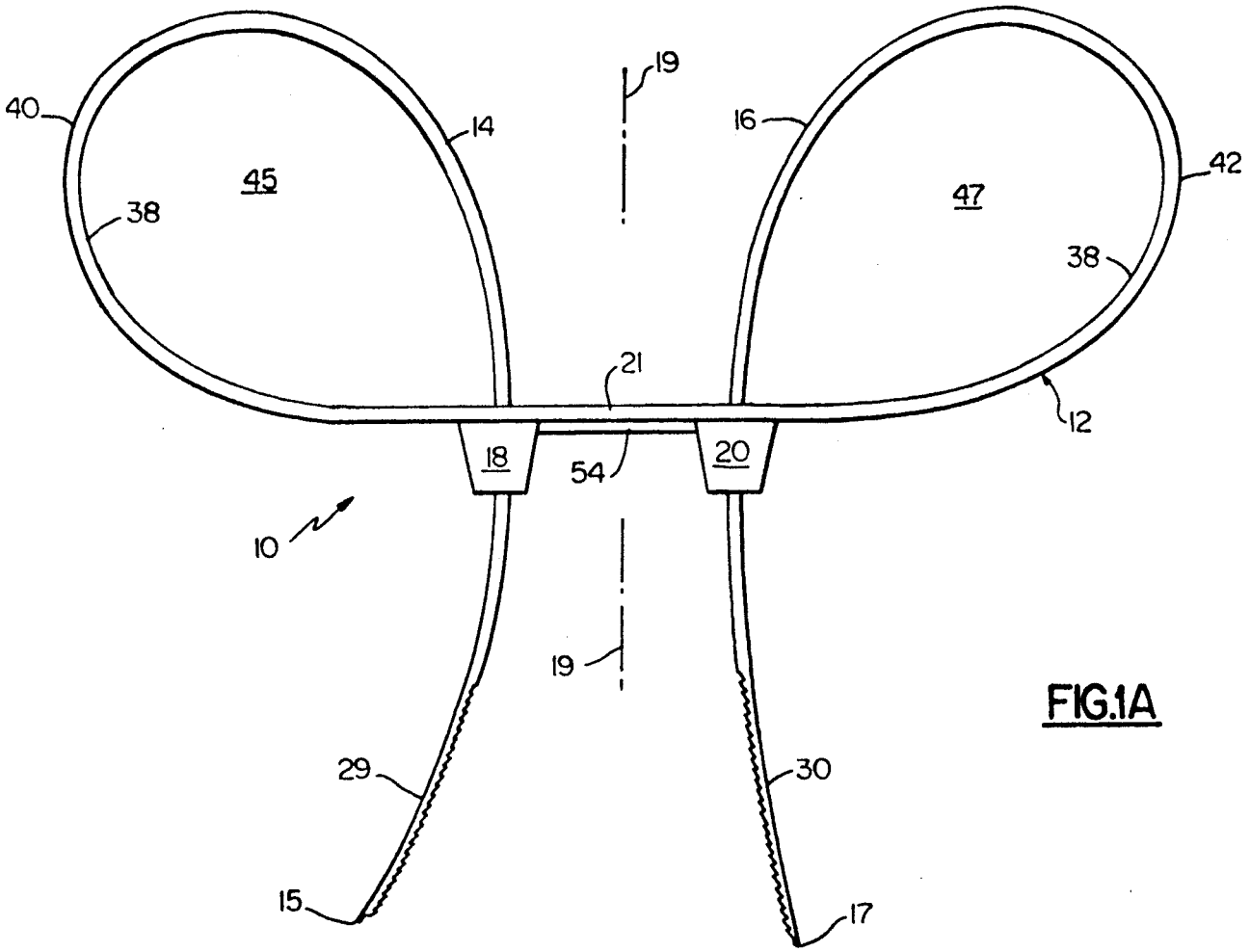
FIG. 1A is a side-elevational view of the law enforcement restraint of FIG. 1 showing how respective ratchet portions of the strap are bent and inserted through a pair of latching sockets for keeping the inserted ratchet portions latched in the respective sockets for providing a two-loop restraint. It is noted that the socket bosses project solely toward the outward side of this restraining strap.

In operation of a restraining device embodying the present invention it will be seen in FIG. 1A that the first ratchet portion 14 is flexed with its bottom (inward) surface 38 facing the wrist or ankle or other object being encircled to form a loop with its narrowed tip pull portion 29 having been inserted through the socket 18 in order for the stiffly flexible ratchet portion to be pulled therethrough to form a first loop 45. Then, the second tip pull 30 and ratchet portion 16 of the strap 12 are looped in the opposite direction and inserted into and pulled through the socket 20 to form a second loop 47.

The relatively close spacing "S" of the socket bosses 18 and 20 serves to restrain the person whose ankles or wrists are in the respective loop configurations 45 and 47. Moreover, since the ratchet portions 14 and 16 are stiffly flexible, they can be flexed as may be desired or required for configuring into various shapes and sizes of loops for snugly and accurately conforming to the perimeter of the encircled ankle, wrist or other anchoring object. In addition, there can be the same or different sizes of loops. The looping arrangement is simple and the flexing direction for each ratchet portion 14 and 16 is conveniently inwardly toward the transverse centerline 19. Thus insertion of the tip pull portions 29 and 30 into the sockets followed by snugging the loops 45 and 47 is easy to do for quickly restraining a person.

It is noted that the first and second ratchet portions 14 and 16 project through their respective sockets generally parallel to each other, and so it is relatively easy to pull the loops 45 and 47 to be the same size, if so desired, by aligning the tip ends 15 and 17 in a final snugging action.

The respective rounded tips and narrowed tip pull portions 15 and 29, 17 and 30 are shaped for ease of insertion into a socket opening 22 or 24, respectively. Since the socket bosses 18 and 20 protrude solely on the top (outward) surface of the strap 12, it is relatively easy for a user in total darkness at night to feel and determine almost immediately where these bosses are located and thereby to know where the funnel-shaped insertion mouths 41 and 43 are located opposite to the respective bosses, thus avoiding confusion and waste of time while facilitating appropriate quick insertion of the respective narrow tip pull portions 29 and 30.

As shown with respect to the latch pawl 26 (FIG. 8) in socket 18, each latch is inclined in the same direction as the distal sloping faces 37 of the saw-tooth ratchet ridges 36, and each latch pawl is resiliently deflectable permitting the latch pawl to ride over the ridges 36 in the upward direction of their slopes during insertion movement but preventing extraction movement, thereby providing a flexible strap ratchet arrangement, which makes the size of a loop 40 or 42 adjustable in the sense that the loop configuration 45 or 47 can always be made smaller until reaching the limit "Y" (FIGS. 3 and 4), as defined by the inner limit of the toothed channel surface 34. The strap has a smooth broad U-shaped portion 53 of length Y near each socket boss where the ratchet teeth are intentionally omitted. Thus, the ratchet portions 14 and 16 cannot become latched in such a tightly-bent loop configuration as to over-stress the strap 12 or socket. Y is about 1.8".

The ratchet portions 14 and 16 each include at least fifty ratchet teeth 36 extending for a length "J" (FIG. 4) of at least about 7.8 inches for providing a relatively wide range of adjustment. Preferably, there are at least sixty ratchet teeth extending along a length J of at least about 9.36 inches. In a more preferred form as shown, there are seventy ratchet teeth extending for length J of about 10.92 inches.

By virtue of the fact that the sockets 18 and 20 are integral with the strap 12 and are located near the transverse centerline 19, the flexing direction is conveniently inwardly from both ends for forming both loops 40 and 42. The resulting dual-loop configurations 45, 47 are advantageously generally symmetrical about the transverse centerline 19 in FIG. 1A, making the installation job easy for the officer, because the left and right loops are symmetrically the same regardless of which one is applied first and regardless of whether the rounded tip 15 is at the left or right, because the overall strap 12 is completely symmetrical about both its transverse and longitudinal centerlines 19 and 25, thus advantageously being fully reversible end-for-end without altering its functional operation.

Although the double-loop configuration 45, 47 (as shown in FIG. 1A) illustrates a downward insertion of the ratchet portions 14 and 16 through their respective sockets 18, 20, the strap 12 can be turned over if desired by the user, so that insertion can be in an upward direction, thereby forming an inverted symmetrical dual-loop configuration as will be seen by inverting FIG. 1A. Accordingly, with guidance by the outwardly protruding socket bosses 18 and 20, it is difficult to make a mistake, as this useful, disposable restraining tool 10 can be used to form a double-loop configuration 45, 47 in either direction and starting with either end. After the loops 45 and 47 have been pulled snug, the end portions of the extremities can then be snipped off, if desired, as being no longer needed. A relatively deep V-shaped notch 56 (FIG. 5) may be provided at the inner end of each tip pull for enabling the tip pull to be broken off by folding sharply at this notch.

The ratchet end 48 (FIGS. 7 and 8) of each resilient latch pawl is shaped, for example, by molding to have a flat surface which is pitched at an acute angle "A" (FIG. 8) for abutting flush against an abrupt mesial face 35 of a ratchet tooth 36. The inclination angle "K" (FIG. 7) of each resilient latch pawl is slightly steeper than the slope angle "D" (FIG. 7) on each ratchet tooth for providing reliably effective ratcheting and latching action. In a presently most preferred embodiment the pawl inclination angle K is 23 with a ratchet tooth slope of 22°. A resilient pawl length "h" (FIG. 7) of about 0.156 of an inch equals the longitudinal ratchet length "C" (FIG. 7) of one tooth 36. A pawl thickness "g" of about 0.070 of an inch is shown. The pawl tip 48 is shown with a width "p" of about 0.170 of an inch for meshing into a ratchet channel width "Z" (FIG. 6) of about 0.187 of an inch. The pawl base width "n" is about 0.180 of an inch for providing stiff resilience while being slightly less than channel width Z. The socket opening 22 is shown in FIG. 7 having a clearance dimension "f" near the pawl base of about 0.135 of an inch for receiving a ratchet portion 14 having an overall thickness "U" of about 0.125 of an inch.

A positive, secure, restraint 10 for law enforcement or medical services and for others is provided which is lightweight and can be used encircling various limbs or anchoring members to restrain people or animals alone or in a group. The device is in the form of a strap which permits easy transportation and enables an officer or other agent to carry ten or twelve of these useful tools without burdening the user with significant extra weight to restrict mobility.

The advantages provided by the illustrative embodiments of the present invention include the following:

1. They can be employed in place of handcuffs by law enforcement agencies for restraining individuals alone, or in a group.

2. By virtue of this dual-loop symmetrical strap restraint being inexpensive and disposable and lightweight, a first officer can readily afford to transfer a prisoner to a second officer, while leaving the restraint installed on the prisoner, because the first officer will have available several more of these restraints. (Whereas, an officer today is likely to possess only one pair of key-operated handcuffs and cannot relinquish possession of the only restraint available, in case another situation might arise during the present tour of duty requiring subsequent restraint of someone else.)

3. The flexibility of the advantageous symmetrical strap configuration enables a second restraint strap 12 to be slipped through a loop 45 or 47 on a first prisoner, or to be passed around the bridging strip 21, thus shackling a second prisoner to a first prisoner. Or, a second restraint strap 12 can be placed around the ankles of a prisoner for hobbling or around an anchoring object. Multiple prisoners can be strung together by employing multiple restraint straps, and so forth, thereby providing great flexibility and great adaptability in uses by law enforcement officers as a variety of circumstances may evolve. Thus, there is an ease for multiple subjects being restrained and moved.

4. The dual-loop strap restraint being symmetrical about both a transverse centerline axis and a longitudinal center line axis is easy to use, being reversible end-for-end and also being invertible, so that the inserted ends 15, 29 and 17, 30 can extend downwardly or upwardly, as may be desired. Thus, there is an ease and convenience of application.

5. The socket bosses 18 and 20 protrude solely on the outward side of the strap restraint, thereby conveniently indicating the locations of the respective funnel-shaped insertion mouths 41 and 43 located on the inward side of the strap opposite the respective socket bosses.

6. The flexible strap shape 12 enables a neat bundle of a dozen or so of them to be carried, for example, wrapped around an officer's waist supported in a carrying sleeve affixed to a belt. Alternatively, a bundle of them can be slung over a shoulder or slung from a belt like a sword, and so forth.

7. Instead of carrying these strap restraints as straight straps, they may be curled into a compact four-loop configuration 50 as seen in FIG. 1 by curling the strap employing first and second apertures 51 and 52 which are located in the relatively wide bridging portion 21 of the strap. Each aperture is sufficiently large for enabling a ratchet portion 14 or 16 plus a narrowed tip pull portion 29 or 30, respectively, to be inserted temporarily through a respective aperture for providing the compact, readily concealable, four-loop configuration seen in FIG. 1. The inserted portions of the strap are easily withdrawable from the apertures 51 and 52.

8. Also, law enforcement personnel may carry one or more of the restraints in prepared shape, ready for quickly and safely securing a prisoner upon apprehension. In order to carry them in this prepared (pre-set) shape, the narrow tip pulls 29 and 30 are inserted only a short distance into the respective openings 22 and 24 of the sockets 18 and 20, thus forming two loops interconnected by the bridging portion 21. Consequently, the resulting loops will be larger than the loops 45 and 47 (FIG. 1A) since the tip pulls have been inserted only a short distance into their respective sockets. During the securing of a prisoner, the officer quickly reduces the size of the previously prepared larger loops, so as to fit snugly around the prisoner's wrists or ankles.

9. The flexibility of the loops 45 and 47 adapts to the shape of the limb of the restrained person, in contradistinction to a rigid metal handcuff.

10. This dual-loop law enforcement strap restraint does not need any key for removal, being inexpensive and disposable it is merely cut or snipped off for release.

11. Since there is no exchanging of handcuffs during transfer of custody of a prisoner, there is less occurrence of body contact between an officer and a prisoner, and so there is reduced risk of an officer's contracting any disease with which the prisoner might be infected.

12. Since there is no exchanging of handcuffs, there is no chance of transferring an infection from one prisoner to the next. This dual-loop symmetrical strap restraint 10 is used only once and then is disposed of.

13. A wide variety of sizes and shapes of loop configurations 45 and 47 can be created as may be appropriate, whereas, a metal handcuff is rigid and thus is considerably more limited in adjustability.

14. Since the bridging portion 21 of the strap which spans across between the two socket clasps is stiffly flexible, the two loops 45 and 47 are enabled to become configured closely to the two limbs of a person when the looped portions 40 and 42 are drawn snug, thereby affording secure restraint together with some degree of compliant comfort for the restrained person.

Figure 4A:
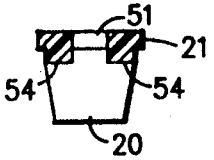
FIG. 4A is a cross-sectional view of the bridging portion of the strap restraint taken along the transverse section line 4A—4A in FIG. 3 and passing through one of the apertures used for compactly curling the strap as seen in FIG. 1.

15. The bridging portion 21 is slightly wider than the socket bosses, as seen in FIGS. 4, 4A and 9. In order to strengthen this bridging portion, there are a pair of parallel, longitudinally extending ribs 54 integrally molded with the socket bosses 18 and 20 and with the bridging portion 21. FIG. 4A shows that these reinforcing ribs are positioned adjacent to the respective ends of the apertures 51 and 52.

In order to provide an even more detailed appreciation for the illustrative embodiments of the present invention, some specific illustrative examples will now be described.

For example, in particular preferred embodiments the length "L" of the straight integral strap 12 with its integral sockets 18 and 20 is in the range from 32 to 38 inches. The spacing "S" between the transverse center lines of the respective sockets 18 and 20 is in a preferred range from about 1.5 to about 3.0 inches and is most preferred to be about 2.0 inches as is shown. Thus, the distance "D" from the transverse centerline 19 to the transverse centerlines of the sockets is in the preferred range from about 0.75 to about 1.5 inches and is most preferred to be about 1.0 inch as is shown.

In the best mode I now contemplate of carrying out this invention, the various dimensions have sizes in inches (or angles in degrees) of about as follows:

| Dimension and FIG.: | | Value of about: |
|---|---|---|
| L | 2 | 33.5 |
| B | 2 | 16.750 |
| D | 2 | 1.000 |
| W | 2 | 0.875 |
| H | 3 | 0.750 |
| F | 4 and 5 | 1.750 |
| G | 4 | 2.000 |
| J | 4 | 10.937 |
| S | 4 | 2.000 |
| K | 5 | 1.650 |
| M | 5 | 0.020 |
| N | 5 | 0.050 |
| O | 5 | 0.080 |
| P | 5 | 0.090 |
| Q | 5 | 0.092 |
| R | 5 | 0.030 |
| T | 5 and 7 | 0.062 |
| U | 5 and 7 | 0.125 |

-continued

| Dimension and FIG.: | | Value of about: |
|---|---|---|
| V | 5 | 0.050 |
| DIAM. | 6 | 0.180 |
| X | 6 | 0.180 |
| Z | 6 | 0.187 |
| C | 6 and 7 | 0.156 |
| f | 7 | 0.135 |
| g | 7 | 0.070 |
| h | 7 | 0.156 |
| r | 7 | 0.225 |
| Angle D | 7 | 22° |
| Angle E | 7 | 10° |
| Angle J | 7 | 2° |
| Angle K | 7 | 23° |
| Angle M | 7 | 45° |
| Angle A | 8 | 67° |
| j | 9 | 0.046 |
| k | 9 | 0.062 |
| l | 9 | 0.180 |
| m | 9 | 0.325 |
| n | 9 | 0.180 |
| p | 9 | 0.170 |

Figure 11:
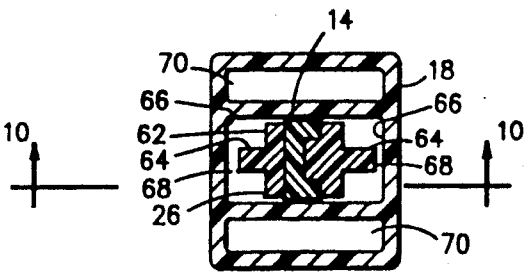
FIG. 11 is a sectional plan view of the modified latching socket of FIG. 10 as seen along the section line 11—11 in FIG. 10.
Figure 10:
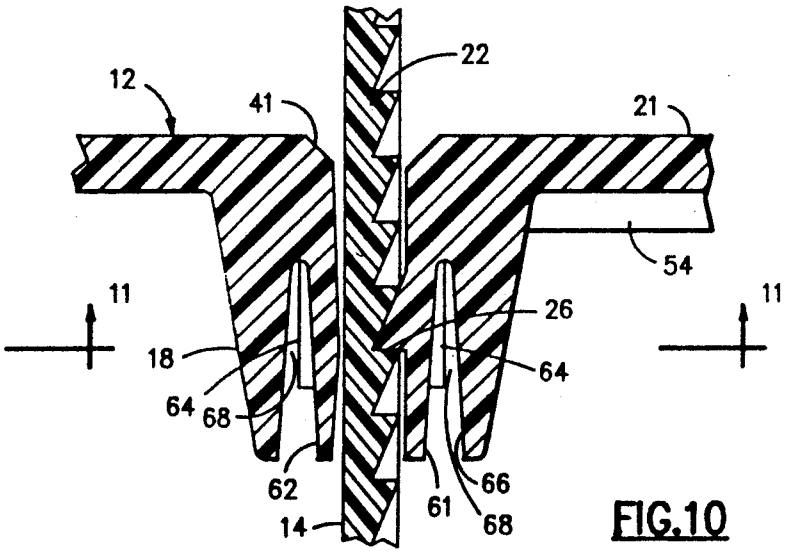
FIG. 10 is an enlarged sectional view of a modified latching socket as seen along the section line 10—10 in FIG. 11.

A modified integrally molded latching socket boss 18A is shown in FIGS. 10 and 11 wherein the resilient latch pawl 26 is very difficult to reach for attempted unauthorized release by using a conventional flat screwdriver blade or similar intrusive implement. Opposed sides of the socket opening 22 are provided by two resiliently deflectable spring tongues 61, 62 each having a rib 64 on the back of the tongue. Thus, each spring tongue 61 and 62 has a T-shaped cross section as seen in FIG. 11. The latch pawl 26 is integral with the first spring tongue 61.

In order to obtain sufficient socket opening clearance for enabling a strap ratchet portion 14 to be pulled through the socket opening 22, both resilient spring tongues 61, 62 must be deflected simultaneously in opposite directions for essentially their full available resilient deflectability. An encircling wall 66 of the socket boss is positioned relatively close to the two ribs 64, thereby providing limited deflection clearance spaces 68 behind the respective ribs of the spring tongues. Essentially, the entire deflection availability provided by the sum of both clearance spaces 68 must be used simultaneously for enabling a strap ratchet 14 to be moved through the socket with the pawl 26 riding over the crests of the ratchet teeth 36.

Consequently, it is very difficult for a restrainee to attempt to release the latch pawl 26 since both spring tongues 61 and 62 must simultaneously be deflected away from the inserted strap ratchet portion 14 in opposite directions to essentially the fullest extent of available deflectability in order to permit the crest of a ratchet tooth 36 to pass by the pawl 26 in the extraction direction, and there is very little access room for simultaneously deflecting both spring tongues by attempting to use two invasive implements simultaneously.

For conserving polymeric material, the encircling wall 66 of the socket boss 18A may include hollows or cavities 70.

Since other changes and modifications varied to fit particular operating requirements and environments will be understood by those skilled in the art, the invention is not considered limited to the foregoing presently preferred examples chosen for purposes of illustration of the best modes currently contemplated for putting this invention into practice, and thus this invention includes all changes and modifications which do not constitute a departure from the true spirit and scope of this invention as claimed in the following claims and equivalents thereto.

What is claimed is:

1. A disposable law enforcement restraint for providing two-loop attachment to limbs of a restrained person comprising:

an elongated strap having first and second stiffly flexible, longitudinally extending ratchet portions, said strap including first and second latching socket bosses spaced longitudinally of the strap and being located in said strap between said first and second stiffly flexible ratchet portions, said first and second latching socket bosses including respective first and second socket openings extending therethrough, first and second resilient latch pawls projecting into said first and second socket openings, respectively, for permitting said first and second ratchet portions of the strap to enter and be moved through the respective first and second socket openings for forming the strap into first and second loops and for thereafter preventing ratchet portions of the strap from being withdrawn from respective socket openings for preventing release of the respective loops, and said restraint being molded entirely as an integral structure from engineering grade polymeric material.

2. A disposable law enforcement restraint as claimed in claim 1, in which:

said engineering grade polymeric material from which said restraint is molded is recyclable.

3. A disposable law enforcement restraint as claimed in claim 2, in which:

said engineering grade polymeric material is selected from the group consisting of Nylon 66 and Nylon 6 each being a virgin resin, impact-modified to enhance flexibility and having a tensile strength of at least about 8,000 psi and a flexural strength of at least about 13,500 psi.

4. A disposable law enforcement restraint as claimed in claim 1, in which:

each of said first and second stiffly flexible ratchet portions includes a row of at least fifty ratchet teeth.

5. A disposable law enforcement restraint as claimed in claim 4, in which:

each row of said ratchet teeth extends for a distance of at least about 7.8 inches along said strap.

6. A disposable law enforcement restraint as claimed in claim 4 in which:

each of said ratchet teeth has a length longitudinally along the strap of about 0.156 of an inch, and each of said first and second resilient latch pawls has a length in a direction parallel with a centerline of the respective first and second socket openings of about 0.156 of an inch.

7. A disposable law enforcement restraint as claimed in claim 4, in which:

each of said ratchet teeth has an abrupt mesial face and has a distal face sloping at a slope angle in a range from about 15° to about 30° relative to the longitudinal direction of said strap.

8. A disposable law enforcement restraint as claimed in claim 7, in which:

the distal faces slope at a slope angle in the range from about 18° to about 25°.

9. A disposable law enforcement restraint as claimed in claim 8, in which:

the distal faces slope at a slope angle of about 22°.

10. A disposable law enforcement restraint as claimed in claim 9, in which:

each of said resilient latch pawls in an undeflected condition is inclined at a pawl angle of about 23°.

11. A disposable law enforcement restraint as claimed in claim 8, in which:

each of said resilient latch pawls in an undeflected condition is inclined at a pawl angle slightly larger than said slope angle, and a difference between said pawl angle and said slope angle is less than about 2°.

12. A disposable law enforcement restraint as claimed in claim 7, in which:

each of said resilient latch pawls in an undeflected condition is inclined at a pawl angle slightly larger than said slope angle, and a difference between said pawl angle and said slope angle is less than about 3°.

13. A disposable law enforcement restraint as claimed in claim 1, wherein the polymeric material from which said strap is molded is recyclable.

14. A disposable law enforcement restraint as claimed in claim 1, in which:

each of said resilient pawls has a tip and a base, and the pawl base is significantly wider than the pawl tip.

15. A disposable law enforcement restraint as claimed in claim 14, in which:

the pawl base has a width of about 0.180 of an inch, and the pawl tip has a width of about 0.170 of an inch.

16. A disposable law enforcement restraint as claimed in claim 15, in which:

each of said resilient pawls has a thickness of about 0.070 of an inch.

17. A disposable law enforcement restraint as claimed in claim 14, in which:

each of said resilient pawls has a thickness of about 0.070 of an inch.

18. A disposable law enforcement restraint comprising:

an elongated strap having first and second stiffly flexible longitudinally extending ratchet portions, first and second sockets on said strap between said ratchet portions, said first and second sockets having first and second socket openings respectively extending therethrough for receiving said first and second ratchet portions inserted into respective first and second socket openings for forming said strap into first and second loops, each of said socket openings being positioned between first and second movable elements resiliently biased toward each other, a latch pawl carried by the first movable element in each socket, each socket including means for limiting extent of movement of both elements for requiring both elements to be displaced simultaneously against resilient bias for substantially all available extent of movement to enable the ratchet portion to pass by said pawl in a forward ratchet direction.

19. A disposable law enforcement restraint as claimed in claim 18, in which:

said first and second movable elements are resiliently deflectable tongues extending along opposite sides of the socket opening.

20. A disposable law enforcement restraint as claimed in claim 19, in which:

each of said first and second resiliently deflectable tongues has a rib extending along a back of the tongue providing a T-shaped cross section for each tongue in which a stem of such T shape extends in a direction away from the socket opening.

21. A disposable socket opening as claimed in claim 20, in which:

said means limiting extent of movement of said first and second elements is a wall of the socket closely spaced to the rib on the back of each tongue, whereby unauthorized withdrawal of a ratchet portion of a strap from a socket opening by attempted use of an invasive implement to dislodge a pawl from a ratchet portion is very difficult to achieve since both movable elements must be displaced simultaneously for substantially their full amount of available movement in order for a crest of a ratchet tooth on the ratchet portion to pass by the pawl.

* * * * *